United States Patent [19]

Friedman

[11] Patent Number: 4,861,546

[45] Date of Patent: Aug. 29, 1989

[54] METHOD OF FORMING A METAL ARTICLE FROM POWDERED METAL

[75] Inventor: Gerald I. Friedman, Cleveland Heights, Ohio

[73] Assignee: Precision Castparts Corp., Portland, Oreg.

[21] Appl. No.: 137,802

[22] Filed: Dec. 23, 1987

[51] Int. Cl.[4] ..... B22F 7/00

[52] U.S. Cl. ..... 419/8; 419/42; 419/48; 419/49

[58] Field of Search ..... 419/8, 42, 48, 49

[56] References Cited

U.S. PATENT DOCUMENTS

| | | | |
|---|---|---|---|
| 3,098,723 | 7/1963 | Micks | 29/183.5 |
| 3,596,703 | 8/1971 | Bishop | 164/132 |
| 3,729,971 | 5/1973 | Gurganus et al. | 72/226 |
| 3,803,702 | 4/1974 | Bratt et al. | 419/8 |
| 3,804,575 | 4/1974 | Chandhok | 425/78 |
| 3,893,852 | 7/1975 | Bergman et al. | 75/224 |
| 3,976,482 | 8/1976 | Larson | 75/211 |
| 4,060,413 | 11/1977 | Mazzei et al. | 75/226 |
| 4,065,303 | 12/1977 | Seilstorfer et al. | 75/226 |
| 4,329,175 | 5/1982 | Turner | 75/226 |
| 4,589,176 | 5/1986 | Rosman et al. | 419/8 |
| 4,657,822 | 9/1987 | Goldstein | 419/8 |
| 4,680,160 | 7/1987 | Helmink | 419/6 |
| 4,772,450 | 9/1988 | Friedman | 419/49 |

FOREIGN PATENT DOCUMENTS 0172658 2/1986 European Pat. Off. .

*Primary Examiner*—Stephen J. Lechert, Jr.
*Attorney, Agent, or Firm*—Taroli, Sundheim & Covell

[57] ABSTRACT

A container for holding powdered metal is formed by electroplating a layer of metal over a pattern having a configuration which corresponds to the configuration of an article to be formed. A rigid core is surrounded by the pattern material and the layer of metal. The pattern material is removed from the layer of metal to form a container in which the core is disposed. The core and container may be held against relative movement by gripping the core with the layer of metal or by pin elements extending between the core and layer of metal. The container is filled with metal powder. The metal powder is cold compacted to plastically deform the particles of metal powder without significant bonding between the particles of metal powder. The metal powder is cold compacted by exposing the container to fluid at a relatively low temperature and high pressure. Metal powder particles are pressed against each other and against the core by the fluid pressure applied against the container to plastically deform the metal powder particles. After being cold compacted, the metal powder is hot compacted to bond the particles of metal powder together and form a unitary body which surrounds the core. The core is subsequently removed from the unitary body to form a recess in the body.

37 Claims, 5 Drawing Sheets

METHOD OF FORMING A METAL ARTICLE FROM POWDERED METAL

BACKGROUND OF THE INVENTION

The present invention relates to a method of forming a metal article, such as an airfoil, from powdered metal.

A method of forming an article, such as a turbine blade, of metal powder is disclosed in European Patent Publication No. 0 172 658 A1, published Feb. 26, 1986 from application Ser. No. 85305176.1 filed July 19, 1985 and entitled Method of Forming Powdered Metal Articles. This publication discloses forming a container by electroplating a layer of metal over a pattern. The pattern is subsequently removed from within the layer of metal to leave the empty container which is filled with a metal powder. After the container has been filled and sealed, the container is subjected to a hot isostatic pressing operation which results in a bonding of the particles of metal powder to form a unitary body.

A method of making a gas turbine blade or rotor from powdered metal is also disclosed in U.S. Pat. No. 4,329,175 issued May 11, 1982 and entitled Products Made by Powder Metallurgy and a Method Therefor. This patent teaches that the physical characteristics of an article formed of metal powder can be made different in different parts of the article by using different metal powders to form different parts of the article. Thus, a first portion of a container is filled with a standard metal powder and a second portion of the container is filled with a treated metal powder having a different physical characteristic.

The treated metal powder referred to in U.S. Pat. No. 4,329,175 is formed by conducting the standard metal powder between a pair of rolls. The rolls mechanically deform the powder in a manner similar to that disclosed in U.S. Pat. No. 3,976,482 issued Aug. 24, 1976 and entitled Method of Making Prealloyed Thermoplastic Powder and Consolidated Article. By using plastically deformed metal powder particles to form one portion of the blade and standard or undeformed particles to form another portion of the blade, different grain growth characteristics are obtained when the metal powder is subjected to a hot isostatic pressing operation.

When metal powder is to be deformed by passing between a pair of rolls, in a manner similar to that taught by the aforementioned U.S. Pat. No. 3,976,482, powder particles are first separated into different sizes and then passed through an appropriately spaced gap in a rolling mill. This results in plastic deformation or strain energizing of the metal powder particles. However, with this process, it is probable that under-sized particles will pass through the rolling-mill gap and will not be cold worked. The particles which are not cold worked will not subsequently recrystallize to a relatively fine grain size. The coarser microstructure region resulting from the powder particles which were not cold worked provides a site for the initiation of a fatigue crack.

BRIEF SUMMARY OF THE INVENTION

The present invention relates to a method of forming a metal article, such as an airfoil, from metal powder. When the metal article is hollow or contains an internal recess, a container for holding metal powder is formed with a core in the container. The container is formed by first covering the core with a body of pattern material having a configuration which is a function of the configuration of the metal article. A layer of metal is deposited over the pattern and the core. The pattern material is then removed from within the layer of metal to leave a container with the core therein. If the metal article does not have an internal recess, the core would be omitted.

The container is filled with metal powder which at least partially surrounds the core. The metal powder is cold compacted by exposing the container to fluid at a relatively low temperature and a relatively high pressure. The fluid pressure against the container presses the particles of metal powder against each other and against the core to plastically deform or cold work all of the metal particles. During cold compacting, there is no significant bonding between the metal particles.

After the particles of metal powder have been cold compacted, they are hot compacted to bond the particles together. This results in the formation of a unitary body which at least partially surrounds the core. The plastically deformed particles of metal powder recrystallize with a fine grain size. The fine grain size of the recrystallized metal powder enhances the fatigue strength of the article. After the hot compacting process has been completed, the core is removed from the unitary body.

When a recess formed in a metal article has an opening at one or both ends of the article, a core may be held in place in the container by having one or both ends of the core gripped by the container. Thus, if the recess has an opening at one end of the article, an end of the core may project from one end of the pattern material. The layer of metal which is deposited over the pattern material to form the container is also deposited over the exposed end of the core. This results in the core being gripped by the layer of metal to hold the core and layer of metal against movement relative to each other.

With certain articles, it is contemplated that it may be desirable to support the core in a manner other than by gripping it with the container. This can be done by having pin elements extend through the pattern material. An outer end portion of each of the pin elements projects from the pattern material and an inner end portion of each of the pin elements engages the core. When a layer of metal is deposited over the pattern material, the metal is deposited around the projecting outer end portions of each of the pin elements to anchor the pin elements in the layer of metal. The pin elements will subsequently position the core during filling of the container with metal powder.

Accordingly, it is an object of the present invention to provide a new and improved method of forming a metal article and wherein a container of metal powder is cold compacted to plastically deform particles of the metal powder by pressing them against each other and against a core, the metal powder being subsequently hot compacted to bond the particles of metal powder together to form a unitary body.

Another object of this invention is to provide a new and improved method of forming an airfoil from metal powder and wherein a container is filled with metal powder, sealed, subjected to a cold compacting process to plastically deform particles of metal powder, and then subjected to a hot compacting process to bond the particles of metal powder together to form a unitary body.

Another object of this invention is to provide a new and improved method of forming an article from metal powder and wherein pin elements extend through a body of pattern material surrounding a core and a layer of metal is deposited over the body of pattern material to anchor the pin elements in place to enable them to position the core after the pattern material has been removed from within the layer of metal.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENT OF THE INVENTION

General Description

Figure 1:
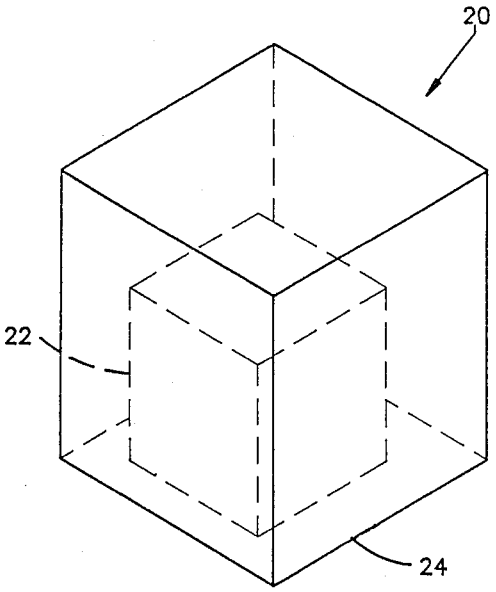
FIG. 1 is a schematic pictorial illustration of an article formed from metal powder and having an internal recess.

A one piece metal article 20 formed of metal powder is illustrated schematically in FIG. 1. The metal article 20 is hollow and has an internal recess 22 which opens into one surface, that is a lower surface 24, of the metal article. Although the metal article 20 is illustrated in FIG. 1 as having a cubic configuration with a cubic internal recess 22, the metal article could have external surfaces and an internal recess 22 with many different configurations, depending upon the intended use of the article.

The article 20 is formed of a titanium alloy. Although the metal article 20 could be formed of many different titanium alloys, the metal article is formed of Ti-6Al-4V alloy. Although it is preferred to form the metal article 20 of a titanium alloy, the metal article could be formed of other alloys, such as a cobalt or nickel alloy.

The metal article 20 has a relatively fine grain size. The fine grain size enhances fatigue strength. Although the fatigue strength of the metal article 20 is enhanced by its fine grain size, there is no loss of tensile or yield strength. The fine grain structure extends throughout the article 20 so that it is free of a coarser-microstructure region which could be a site for initiation of a fatigue crack.

Figure 2:
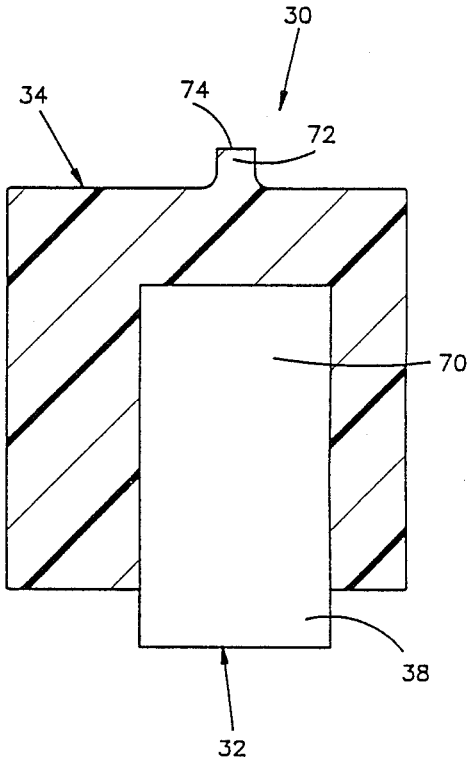
FIG. 2 is a sectional view illustrating a pattern assembly which is used in forming the article of FIG. 1.

The metal article 20 is made from metal powder. In order to make the article, a pattern assembly 30 (FIG. 2) is formed. The pattern assembly 30 includes a rigid core 32 which is partially enclosed by a body 34 of pattern material. A layer 36 (FIG. 3) of metal is electroplated over an exposed end portion 38 of the core 32 and over the body 34 of pattern material. Although it is preferred to deposit the layer 36 of metal over the core 32 and body 34 of pattern material by electroplating, other known methods of depositing the metal layer 36 could be used if desired. The body 34 of pattern material is then removed from within the layer 36 of metal to leave a container 42 (FIG. 4) in which the core 32 is disposed.

The empty container 42 is filled with metal powder 44 (FIG. 4) through an opening 46. The opening 46 is then sealed by a plug or closure member 48 (FIG. 5). The powdered metal 44 is subjected to a cold compacting process by exposing the sealed container 42 to fluid at a relatively low temperature and a relatively high pressure. The equal forces exerted by the fluid pressure about the entire outer surface of the container 42 have been indicated by the arrows 50 in FIG. 5.

Figure 6:
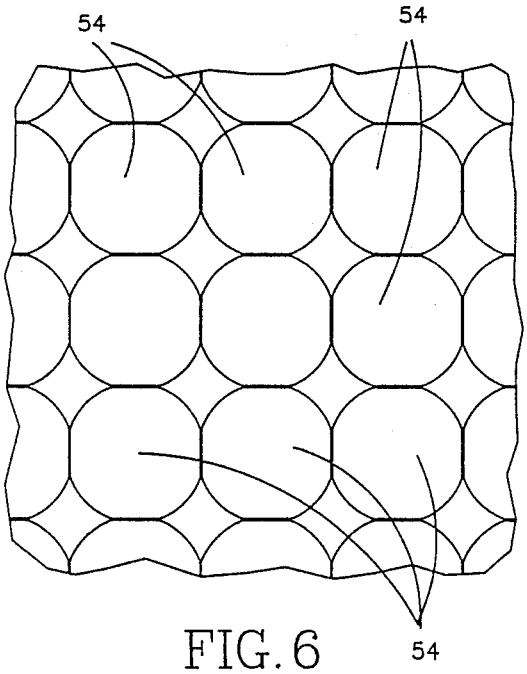
FIG. 6 is a greatly enlarged schematic illustration depicting the manner in which spherical particles of metal powder are plastically deformed against each other during cold compacting.
Figure 7:
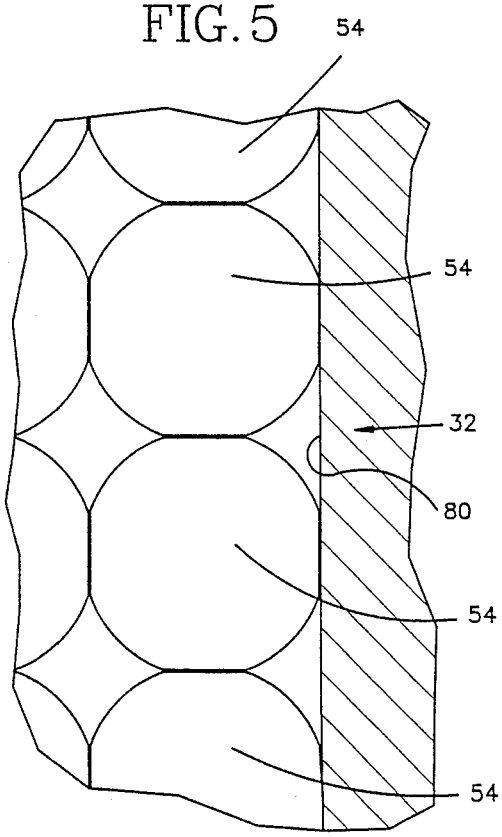
FIG. 7 is an enlarged schematic illustration depicting the manner in which spherical particles of metal powder are plastically deformed against the core during cold compacting.

The relatively flexible container 42 is compressed radially inwardly by the fluid pressure 50. This presses spherical metal powder particles 54 against each other and plastically deforms the metal powder particles in the manner illustrated schematically in FIG. 6. In addition, the metal powder particles 54 are plastically deformed by being pressed against the core 32 (FIG. 7). This results in cold working of all the spherical metal powder particles 54 in the sealed container 42.

Figure 8:
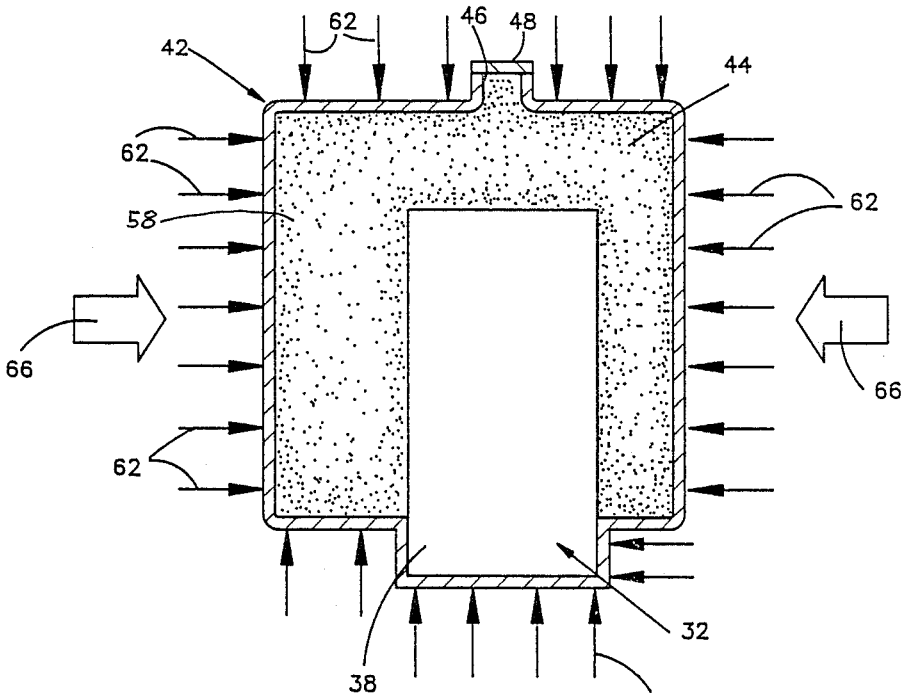
FIG. 8 is a schematic illustration depicting the manner in which the metal powder in the container is hot compacted after being cold compacted.

After all the metal powder 44 in the container 42 has been cold compacted, in the manner indicated schematically in FIG. 5, the metal powder is hot compacted in the manner indicated schematically in FIG. 8. During cold compacting of the metal powder 44 in the manner indicated in FIG. 5, there is no significant bonding between the particles 54 (FIG. 6) of the metal powder 44. However, during the hot compacting, the particles 54 of the metal powder are bonded together to form a unitary body 58 having a configuration corresponding to the configuration of the article 20.

During hot compacting of the metal powder 44 (FIG. 8), the entire outside surface of the sealed container 42 is again exposed to fluid pressure forces, indicated schematically by the arrows 62 in FIG. 8 and to heat, indicated schematically by arrows 66 in FIG. 8. The effects of heat and pressure results in the metal powder particles being bonded together to form a unitary body 58. After the metal powder 44 has been hot compacted to form a unitary body 58, the metal layer of the container 42 is removed and the core 32 is removed to form the article 20 of FIG. 1. If the article 20 was solid rather than having the recess 22, the core 32 could be omitted.

During the hot compacting of the powdered metal 44, the powdered metal particles 54 diffusion bond together and recrystallize with a very fine grain size. This fine grain size results from the strain energizing or cold working of the particles 54 of powder metal during cold compacting. Since the container 42 is relatively soft and ductile, it yields inwardly during cold compacting so that all of the metal powder particles 54 are plastically deformed during the cold compacting process. Therefore, all of the powder metal particles 54 recrystallize during hot compacting to form a uniform fine grain throughout the article 20.

If contaminants, that is particles of foreign materials, enter the container 42, the strength of the article 20 will be impaired. Therefore, the container 42 is sealed immediately after it is filled with the metal powder 44. The container 42 is maintained in a sealed condition until the hot compacting process has been completed. Therefore, contaminants cannot enter the sealed container during cold and hot compacting of the metal powder.

Forming the Container

Figure 4:
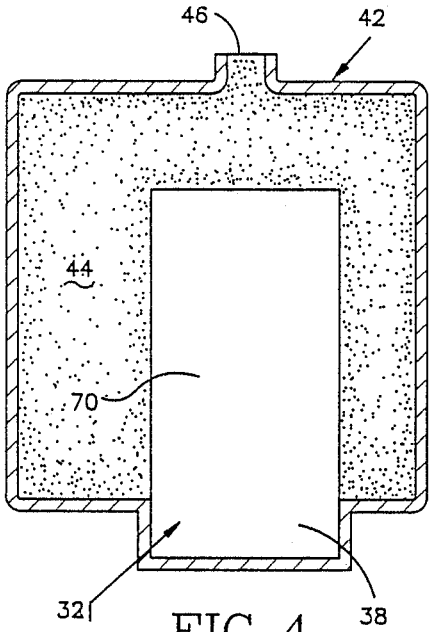
FIG. 4 is a sectional view illustrating a container formed by removing the pattern material from within the metal layer of FIG. 3, the container being filled with metal powder.
Figure 5:
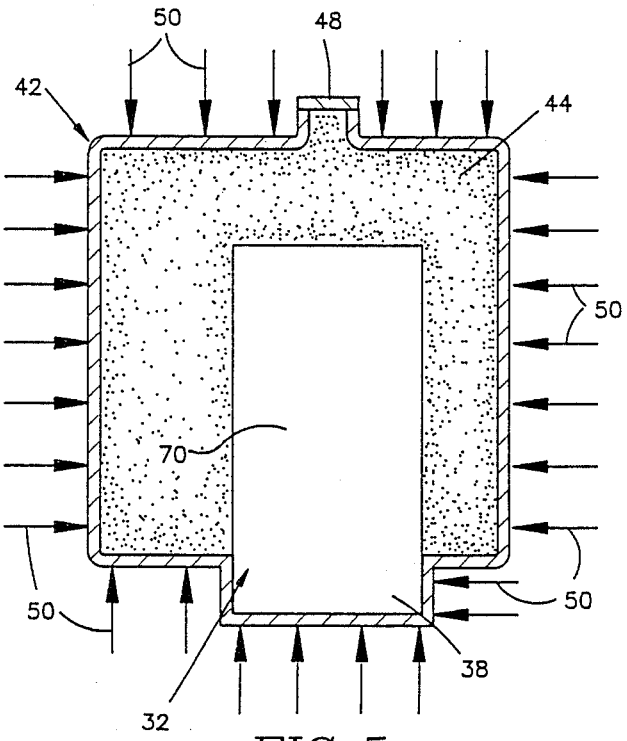
FIG. 5 is a schematic illustration depicting the manner in which metal powder in the container of FIG. 4 is cold compacted by exposing the container to fluid at a relatively low temperature and high pressure.

The pattern assembly 30 (FIG. 2) is used in forming the container 42 (FIG. 4). The pattern assembly 30 includes a core 32 which, with the exception of the outwardly projecting end portion 38, is enclosed by the body 34 of pattern material. The inner portion 70 of the rigid core 32, that is the portion of the core enclosed by the pattern material 34, has a configuration which corresponds to the configuration of the recess 22 (FIG. 1) in the article 20. Since the recess 22 has a rectangular configuration, the inner portion 70 of the core 32 also has a rectangular configuration. The rigid core 32 is formed of a low carbon steel which contains less than twelve percent chromium.

The body 34 (FIG. 2) of pattern material has a configuration corresponding to the configuration of the article 20. Since the article 20 is formed as a rectangular cube, the body 34 of pattern material is also formed as a rectangular cube. However, the body 34 of pattern material has a projection 72 which facilitates forming the inlet 46 (FIG. 4) through which powdered metal is poured into the container 42. Although many different types of known pattern materials could be used, the body 34 of pattern material is advantageously formed of wax, that is either a natural wax or a synthetic wax. With the exception of the projection 72, the outer side surfaces of the wax body 34 of pattern material have configurations corresponding to the configurations of outer side surfaces of the article 20.

When the pattern assembly 30 (FIG. 2) is to be formed, the steel core 32 is mounted in an accurately formed master die. Surfaces of the master die grip the end portion 38 of the core while the portion 70 of the core extends into a die cavity. The die cavity has a configuration corresponding to the configuration of the article 20 and the body 34 of pattern material. However, the size of the master die cavity is slightly larger than the body 34 of pattern material to compensate for shrinkage of the pattern material.

Hot wax or plastic is injected into the die cavity around the inner end portion 70 of the core 32. Once the hot wax or plastic pattern material has solidified in the master die cavity, the die is opened and the body 34 of pattern material and core 32 are removed from the master die. The manner in which the pattern assembly 30 is formed is similar to the manner in which patterns containing cores are formed for use in an investment casting process.

The outer surfaces of the body of pattern material 34 is then made electrically conductive by spraying a continuous layer of silver over the surface area of the body 34 of pattern material. However, the layer of silver is removed from a circular end surface 74 (FIG. 2) of the projection 72 so that this surface is not electrically conductive. Although it is preferred to spray the pattern material 34 with silver, graphite or any other conductive material could be sprayed onto the pattern material. It is also contemplated that the outer surfaces of the body 34 of pattern material could be made conductive by application of an electroless nickel or nickel-cobalt coating or by vapor deposition of any other metal.

A continuous thin metal layer 36 (FIG. 3) is deposited over the outer surface of the body 34 of pattern material and over the exposed end portion 38 of the metal core 32. Since the end surface 74 of the projection 72 was not made electrically conductive, the continuous metal layer 36 will not extend over the end surface 74. However, the metal layer 36 extends over all other exposed surfaces of the body 34 of pattern material and over all exposed surfaces of the core 32. This results in the core 32 being enclosed by the layer 36 of metal. If desired, the metal layer 36 could extend over the end surface 74 of the projection 72 and be subsequently removed to form an opening.

Although other methods could be used, it is preferred to deposit the metal layer 36 on the pattern assembly 30 by electroplating the pattern assembly with a layer of nickel. In order to minimize the cost of electroplating, the layer 36 of nickel should be as thin as is reasonably possible. However, the metal layer 36 should be thick enough to be self supporting during filling of the container 42 with powdered metal and to withstand the relatively high fluid pressures to which the container 42 is exposed during cold and hot compacting of the powdered metal 44. In addition, the layer 36 of metal should have a thickness which is sufficient to enable it to grip the exposed end portion 38 of the core 32 to hold the layer of metal and core against movement relative to each other. The thickness of the layer 36 of metal may range between 0.010 to 0.080 of an inch. In one specific embodiment, the layer 36 was formed of nickel having a thickness of 0.050 an inch.

After the pattern assembly 30 has been electroplated with the layer 36 of nickel or other metal, it is necessary to remove the body 34 of pattern material from within the layer of metal. To accomplish this, the pattern assembly 34 and layer of metal 36 are heated to a temperature above the melting point of the wax forming the body 34 of pattern material and below the melting point of the layer 36 of metal. The molten wax then flows out of the opening 46 formed by the projection 72. Of course, if the metal layer 36 extended across the surface 74 of the projection 72, the metal layer would have to be cut away from the surface 74 to provide an opening through which the molten wax could flow.

The conducting of molten wax from the inside of the layer 36 of metal could be promoted by forming an opening at the opposite end of the layer 36 of metal. Thus, there could be two projections, that is a projection corresponding to the projection 72 of FIG. 2 and a second projection on the lower side of the body 34 of pattern material adjacent to the exposed outer end portion 38 of the core 32. One of the two openings would be sealed before filling of the container 42 (FIG. 4) with metal powder to prevent a loss of powder from the lower opening.

The wax which remains in the interior of the layer 36 of metal is cleaned out with a hot solvent. Conducting the solvent through the layer 36 of metal is facilitated if two openings are formed in the layer of metal. If the body 34 of pattern material was made conductive with silver, the silver is removed with a suitable reagent, such as a hot nitric acid solution. However, if the body 34 of pattern material is made conductive with graphite, the graphite does not have to be removed since it will block the diffusion of nickel into the titanium powder 44 during hot compacting of the titanium powder.

As the body 34 of pattern material is removed from inside the layer 36, the container 42 (FIG. 4) is formed. The upper end portion 70 of the core 32 projects into the interior of the container 42 and is spaced apart from the side walls of the container. However, the lower (as viewed in FIG. 4) end portion 38 of the core 32 is securely gripped by the container 42. The interconnection between the end portion 38 of the core and the container 42 holds them against movement relative to each other. Therefore, the core 32 extends into the open interior of the container 42 in the same manner as in which the recess 22 (FIG. 1) extends into the interior of the article 20.

Cold Compacting The Metal Powder

In order to cold compact the metal powder 44, the container 42 is filled with the powder (FIG. 4). Before the container 42 is filled with powder 44, the container is evacuated. The container 42 is then filled in a vacuum environment. This enables the powder 44 to be poured freely into the container 42 through the opening 46 without having a counter flow of gas from the container during filling of the container. The metal powder 44 surrounds the inner portion 70 of the core 32 and completely fills the container 42.

In one specific instance, the metal powder 44 was Ti-6Al-4V having spherical particles. The spherical particles of the titanium alloy powder are formed by a rotating electrode process similar to that disclosed in U.S. Pat. No. 3,099,041 issued July 30, 1963 and entitled Method and Apparatus for Making Powder. The spherical particles may have a size between 50 to 500 microns. Of course, other metal powders having different particle sizes and shapes could be utilized if desired.

Due to the spherical configuration of the particles 54 (FIG. 6) of the metal powder 44 (FIG. 4) there is a relatively high density of metal powder in the container. Thus, there would be a bulk density from 60 to 65 percent. This relatively high bulk density facilitates the accurate formation of the article 20.

After the container 42 has been completely filed with metal powder 44 (FIG. 4), the container is immediately sealed with an end cap or closure 48 (FIG. 5). The metal powder 44 in the sealed and filled container 42 is cold compacted to plastically deform the particles 54 of metal powder without significant bonding between the particles. This is accomplished by subjecting the container 42 to a cold isostatic pressing process.

The sealed and filled container 42 is immersed in water in a cold isostatic press. The fluid pressure force applied by the water against the outside of the container 42 is increased, in the manner indicated by the arrows 50 in FIG. 5. The hydrostatic force applied against the container 42 is sufficient to deform the container 42 and the powder metal particles 54 (FIGS. 6 and 7).

The fluid pressure 50 (FIG. 5) applied to the container 42 to cold compact the metal powder 44 is between 10,000 and 80,000 pounds per square inch. The application of a hydrostatic pressure to the container 42 takes place at a relatively low temperature, that is at a temperature less than 250° F. and usually about 75° F. The maximum fluid pressure may be maintained for only a very short time. In one specific instance, a titanium alloy powder 44 was cold compacted with a fluid pressure which built up to 60,000 pounds per square inch at a temperature of approximately 75° F. Once the maximum pressure of 60,000 pounds per square inch had been reached, the fluid pressure was relieved.

The hydrostatic pressure, indicated schematically by the arrows 50 in FIG. 5, against the outside of the container 42 presses the spherical metal powder particles 54 (FIG. 6) against each other. The hydrostatic pressure force is sufficient to plastically deform the spherical metal powder particles 54 in the manner indicated schematically in FIG. 6. In addition, the spherical metal powder particles 54 are pressed against an outer side surface 80 (FIG. 7) of the core 32. The force pressing the metal powder particles 54 against the surface 80 of the core 32 is sufficient to plastically deform the metal particles in the manner indicated schematically in FIG. 7. The cold working or strain energizing of the spherical metal particles 54 by pressing them against each other and against the core 32 is accomplished without significant bonding between the particles. Thus, the metal powder particles 54 do not bond to each other and do not bond to the core 32 during cold compacting of the metal powder 44.

Since the entire container 42 is exposed to the fluid pressure forces 50, the relatively ductile metal of the container 42 yields inward and transmits the fluid pressure forces 50 to the metal powder particles 54. This results in all of the metal powder particles 54 being plastically deformed by the fluid pressure force. Since each of the particles 54 of metal powder is cold worked or strain energized, a uniform recrystallization occurs throughout the metal article 20 during hot compaction of the metal powder 44.

Hot Compacting The Metal Powder

After the metal powder 44 has been cold compacted, the metal powder is hot compacted to bond the powder metal particles 54 together in a unitary body 58 (FIG. 8) which extends around the core 32. During hot compacting of the metal powder particles 54, the cold worked metal powder particles recrystallize with a relatively fine grain structure. This fine grain structure enhances the fatigue strength of the article 20 without effecting the tensile and yield strengths of the article.

To hot compact the metal powder 44, the sealed container of cold worked or strain energized metal powder is subjected to a hot isostatic pressing operation in an autoclave. Thus, the sealed container 42 of metal powder is placed in a hot gas autoclave and heat, indicated schematically by the arrows 66 in FIG. 8, is transmitted through the container 42 to the metal powder 44 and core 32. The metal powder 44 is heated to a temperature sufficient to promote diffusion bonding of the particles 54 of metal powder.

Contemporaneously with the heating of the metal powder 44, the exterior of the container 42 is exposed to an inert gas, such as argon, at a relatively high pressure. The fluid pressure against the container 42 causes the container to yield inward and transmits the force to the metal powder particles 54. The force 62 exerted by the fluid pressure and heat 66 is maintained for a time sufficient to cause the metal powder particles to bond together to form a unitary body which extends around the rigid metal core 32.

The specific temperature to which the metal powder 44 is heated during a hot isostatic pressing operation will vary depending upon the composition of the metal powder, the magnitude of the pressure and the time for which the pressure is maintained. However, it is preferred to heat titanium alloy powder into a temperature range of 1,200° to 1,850° F. while maintaining the fluid pressure in a range between 15,000 and 45,000 pounds per square inch for a period of one and a half to three hours. The application of heat and fluid pressure for this length of time is sufficient to cause the metal powder particles 54 to bond together to form a unitary body 58 around the core 32. The metal particles 54 which were previously plastically deformed by being cold compacted, recrystallize with a fine grain.

After completion of hot compacting of the metal powder 44 around the core 32, the metal container 42 is removed from the outside of the body 58 and the exposed end portion 38 of the core 32. This is done by exposing the container 42 to a hot nitric acid solution. In addition, the core 32 is removed from the inside of the body 58 by exposing the core to a hot nitric acid solution. Since the core 32 is formed of a low carbon steel having a chromium content of less than twelve percent, the core is dissolved by the hot nitric acid solution. This results in the formation of a recess having a configuration corresponding to the configuration of the recess 22 in the metal article 20. The unitary body 58 will have a projection where the opening 46 to the container 42 was formed. This projection is removed to give the unitary body 58 a configuration corresponding to the configuration of the metal article 20.

EXAMPLES

When an article 20 is formed by first cold compacting metal powder and then hot compacting the metal powder in the manner previously explained, the article will have a relatively high fatigue strength. It is believed that this high fatigue strength is due to the fine grain which results from cold compacting the metal powder before hot compacting the metal powder. In order to determine the effect of the cold compacting, two groups of sample articles were made. The first group of articles were made from powder which was not cold compacted. The second group of articles were made from powder which was cold compacted.

The first group of three sample articles were made from minus thirty five mesh (less than 500 micrometer) titanium alloy powder (Ti-6Al-4V). Three containers of powder were subjected to hot isostatic pressing at 1,500° F. and a pressure of 15,000 pounds per square inch for two hours. The three samples were then annealed at a temperature of 1,300° F. for twenty-four hours. The three samples were not cold compacted prior to being hot compacted. Upon testing, fatigue failures of the three samples occurred at 41,900 cycles; 60,040 cycles; and 70,100 cycles.

A second group of three sample articles were made from minus thirty five mesh (less than 500 micrometer) titanium alloy powder (Ti-6Al-4V). Three containers of the powder were cold compacted at approximately 75° F. and a pressure of 60,000 pounds per square inch in a cold isostatic press. These three samples were then subjected to a hot isostatic pressing at 1,500° F. and a pressure of 15,000 pounds per square inch for two hours. The three samples were then annealed at 1,300° F. for twenty-four hours. Upon testing, these samples failed at 176,440 cycles; 213,960 cycles; and 215,380 cycles.

The only substantive difference between the first group of samples and the second group of samples is that the second group of samples was cold compacted before being hot compacted. As a result of the cold compacting, there was a substantial increase in the fatigue life of the samples. Although the second group of samples had a far greater fatigue life than the first group of samples, they had approximately the same tensile and yield strength. Thus, a sample corresponding to the first group had a tensile strength of 147,500 pounds per square inch and a yield strength of 144,000 pounds per square inch. A sample corresponding to the second group had a tensile strength of 147,000 pounds per square inch and a yield strength of 144,500 pounds per square inch.

Airfoil-First Embodiment

Figure 9:
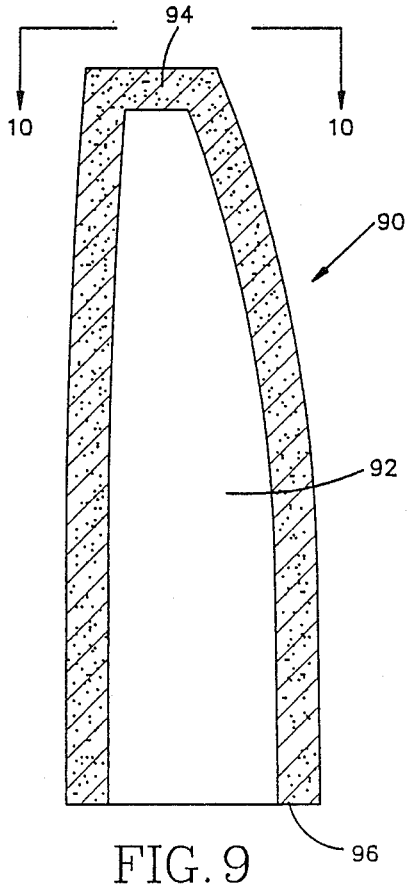
FIG. 9 is a schematic sectional view illustrating the construction of an airfoil formed of metal powder and having an internal recess.
Figure 10:
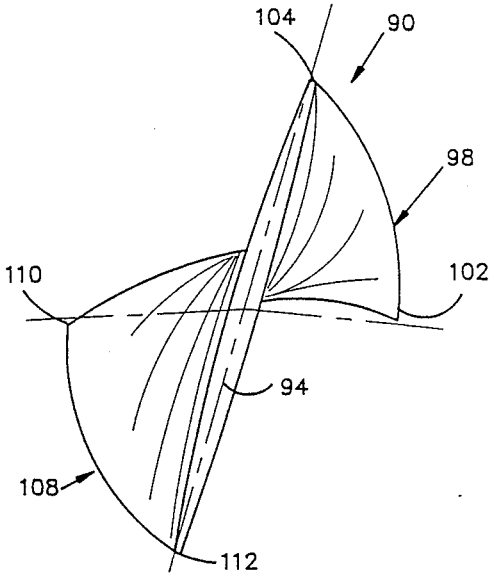
FIG. 10 is a plan view, taken generally along the line 10—10 of FIG. 9, illustrating the manner in which the airfoil of FIG. 9 is twisted about its longitudinal central axis.

A metal airfoil 90 is illustrated schematically in FIGS. 9 and 10. The metal airfoil 90 is made from powdered metal and has an internal recess 92 (FIG. 9). The metal airfoil 90 is a blade for a turbine engine. The airfoil 90 is formed of a titanium alloy, specifically titanium Ti-6Al-4V. The airfoil 90 has a very fine grain to enhance its fatigue strength.

The airfoil has a tip end portion 94 and a root end portion 96. The recess 92 extends from the tip end portion 94 through the root end portion 96 and is open only at the root end portion of the airfoil. The airfoil 90 has a relatively severe twist about its longitudinal central axis. Thus, the leading edge 98 has a root end portion 102 which is angularly offset from a tip end portion 104 by an angular distance of almost 80°. Similarly, a trailing edge 108 of the airfoil 90 has a root end portion 110 which is offset from a tip end portion 112 by an angular distance of almost 80°.

The making of an airfoil having the configuration of the airfoil 90 and the requisite physical characteristics by casting or forging techniques would be very difficult if not impossible. However, the metal airfoil 90 is made by cold compacting metal powder to plastically deform the particles of metal and then hot compacting the metal powder particles to bond them together in the manner previously described in regard to the article 20 and FIGS. 1–8.

The airfoil 90 has an internal recess 92. Therefore, a rigid metal core 116 (FIG. 11) having a configuration corresponding to the configuration of the recess 92 in the airfoil 90 was provided. The recess 92 and steel core 116 have the same twisted configuration as the leading and trailing edges 98 and 108 of the airfoil 90. A body 118 (FIG. 11) of wax pattern material encloses the core 116. An end portion 120 of the core 116 projects from the body 118 of pattern material in much the same manner as in which the end portion 38 (FIG. 2) of the core 32 projects from the body 34 of pattern material. If the recess 92 was omitted from the airfoil 90, the core 116 would not be required.

A metal layer 122 is deposited over the body 118 of pattern material and over the exposed end portion 120 of the core 116. The metal layer 122 is formed of nickel and is deposited by an electroplating process. With the exception of a circular opening 124, the thin continuous metal layer 122 completely encloses the core 116 and body 118 of pattern material.

The body of pattern material 118 is then melted and conducted from inside the layer 122 of metal to form a container. The container is subsequently evacuated and filled with metal powder. The filled container is immediately sealed. The metal powder completely fills the container and surrounds the core 116. The metal powder is a titanium alloy and has spherical metal particles in the manner previously explained in conjunction with the embodiment of the invention illustrated in FIGS. 1–8.

The metal powder in the filled and sealed container is then cold compacted to deform the particles of metal powder, in the manner illustrated schematically in FIGS. 5–7. After being cold compacted, the metal powder in the container is hot compacted, in the manner indicated schematically in FIG. 8, to form a unitary body. The metal container is removed from the outside of the unitary body and the core is removed from the inside of the unitary body. This results in the formation of the metal airfoil 90 (FIGS. 9 and 10) with a fine grain structure which greatly enhances the fatigue strength of the metal airfoil.

Airfoil Second Embodiment

Figure 11:
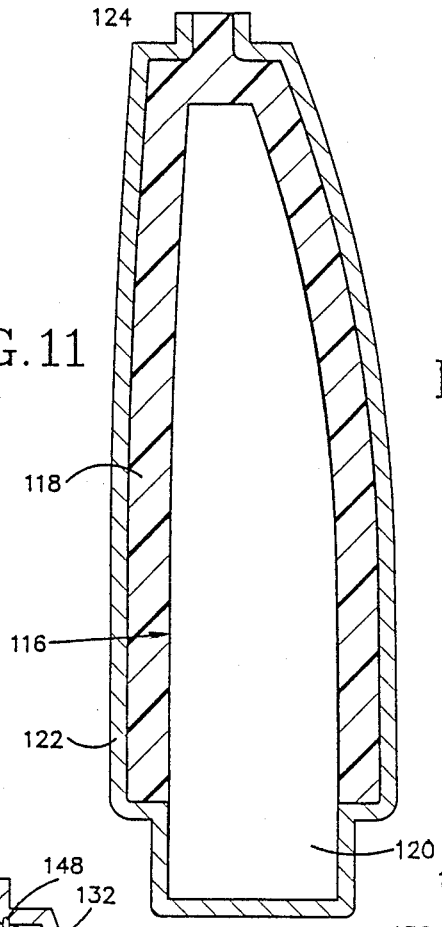
FIG. 11 is a sectional view illustrating a layer of metal deposited over a pattern assembly which corresponds to the airfoil of FIGS. 9 and 10.

In the embodiment of the invention described in conjunction with FIGS. 9–11, the portion 120 of the core 116 is gripped by the layer 122 of metal which is electroplated over the body 118 of pattern material and the core. This results in the airfoil 90 having a recess 92 which is fully opened at the root end portion 96 of the airfoil. However, it is contemplated that it may be desired to form an airfoil similar to the airfoil 90 with a recess having only relatively small openings at the root and/or tip portion of the airfoil. In order to do this, the core 120 and metal layer 122 must be positioned relative to each other in some way other than gripping the core with the metal layer in the manner illustrated in FIG. 11.

Figure 12:
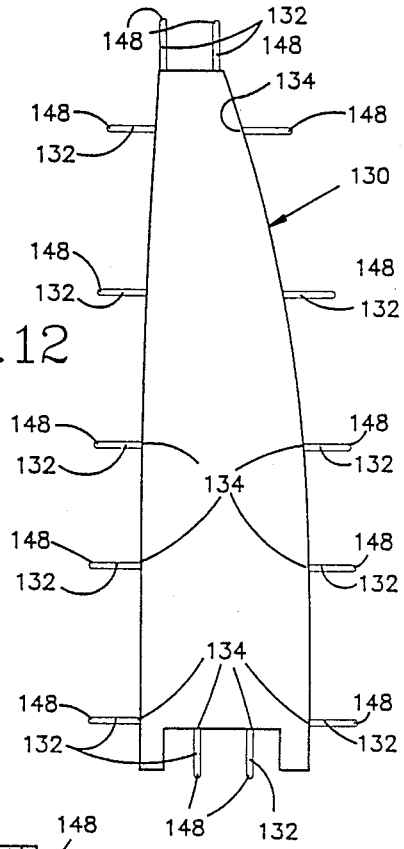
FIG. 12 is a plan view of a core which is used to form a recess in an airfoil, the core being provided with a plurality of outwardly extending pin elements.
Figure 13:
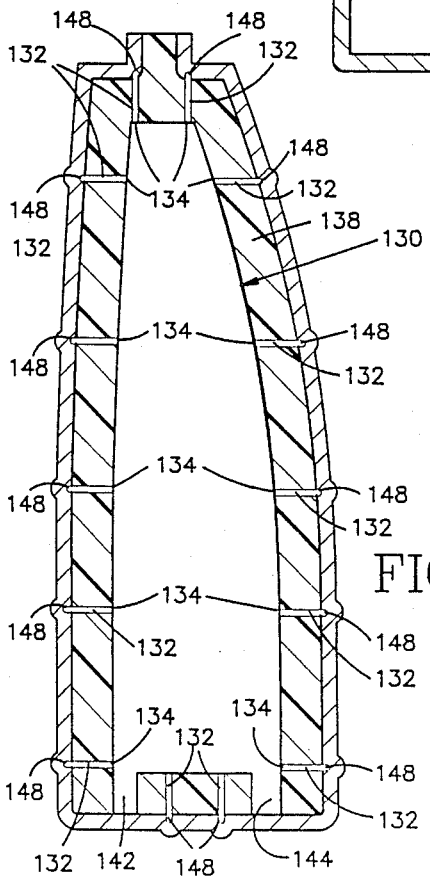
FIG. 13 is a plan view illustrating the relationship between the core of FIG. 12, a body of pattern material, and a layer of metal which has been deposited over the core, the body of pattern material and around end portions of the pin elements.
Figure 14:
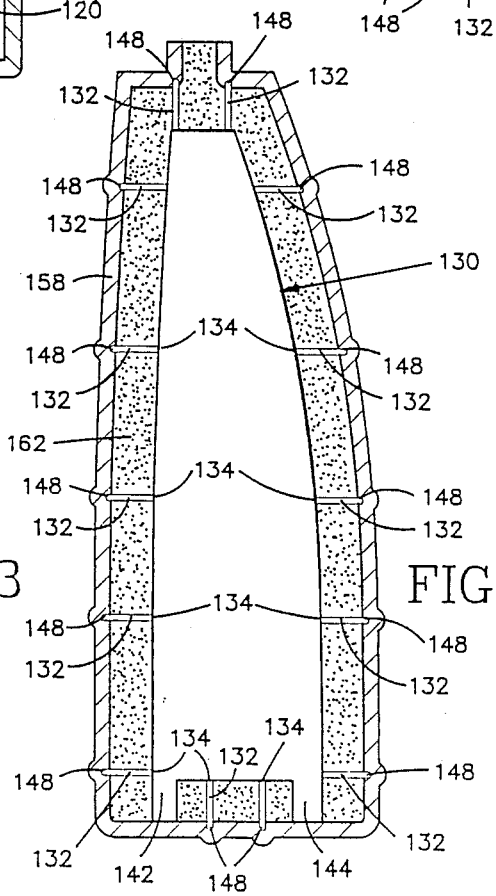
FIG. 14 is a plan view illustrating the manner in which the pin elements position the core of FIGS. 12 and 13 in a container formed by removing the body of pattern material.

In accordance with a feature of the embodiment of the invention illustrated in FIGS. 12–14, a rigid metal core 130 (FIG. 12) is positioned relative to a metal layer (FIG. 13) and container (FIG. 14) by a plurality of pin elements 132 which project outwardly from the core 130. Inner end portions 134 (FIG. 12) of the pin elements 132 are fixedly connected to the steel core 130. This may be done by forming recesses in the core into which the inner end portions of the metal pin elements 132 are inserted. However, the metal pin elements 132 could be welded or otherwise secured to the core 130 if desired.

The rigid steel core 130 is enclosed by a body 138 of wax pattern material. The body 138 of pattern material has a configuration corresponding to the desired configuration of an airfoil. The pin elements 132 have outer end portions 148 which project outwardly of the body 138 of pattern material. The core 130 has a configuration corresponding to the configuration of a desired recess in the airfoil. The core 130 has a pair of projections 142 and 144 with end surfaces which are aligned with the exterior surface of the body 138 of pattern material (FIG. 13).

To enclose the core 130 with the body 138 of pattern material, the core 130 is placed in a master die. Outer end portions 148 of the pin elements 132 extend into recesses formed in the die. The core is supported by the pin elements 132 in a central portion of a die cavity having a configuration corresponding to the configuration of the body 138 of wax pattern material. With the exception of the end surfaces of the projections 142 and 144, the surfaces of the core 130 are spaced from the surfaces of the die cavity.

Once the core has been positioned in the die cavity and the die closed, hot wax or plastic is injected into the die cavity. The hot wax solidifies around the core 130 and pin elements 132. Since the core 130 is spaced from the surface of the die cavity, the wax pattern material surrounds the entire core except for the end surfaces of the projections 142 and 144. Since the outer end portions 148 of the pin elements 132 are enclosed by sections of the master die, the outer end portions of the pin elements project outwardly from the body 138 of pattern material (FIG. 13).

The core 130 and body 138 of pattern material are removed from the master die. The body 138 of wax pattern material is then covered with a coating of an electrically conductive material such as silver or graphite. A metal layer 152 (FIG. 13) is then electroplated over the body 138 of pattern material and core 130. Although it is preferred to use electroplating techniques to deposit the layer 152 of metal over the body 138 of pattern material and core 130, other techniques could be utilized to deposit the metal layer 152 if desired.

The layer 152 of metal extends over the exposed end portions 148 of the metal pin elements 132 and grips the exposed end portions of the pin elements. This results in the outer end portions 148 of the pin elements 132 being firmly anchored in the metal layer 152. Since the inner end portions 134 of the pin elements 132 are connected to the core 130, the pin elements securely interconnect the core and metal layer and hold them against movement relative to each other.

The pattern material 138 is then melted and removed through an opening 154 at one end of the layer 152 of metal to form a container 158 (FIG. 14) in which the core 130 is supported by the pin elements 132. Thus, the metal pin elements 132 extend through the space between the core 130 and container 158 to interconnect the core and container and hold them against relative movement. Although the projections 142 and 144 on the core 130 abut the container 158, the core is primarily supported by the pin elements 132. The projections 142 and 144 are for the purpose of providing access to facilitate removal of the core.

The container 158 is then filled with metal powder 162 (FIG. 14). The metal powder 162 has spherical particles which fill the space between the core 130 and container 158. The metal powder 162 surrounds the pin elements 132 and the core 130. The pin elements 132 are advantageously formed of a material which is the same as at least one of the major components of the metal powder 162. Thus, the metal powder 162 is a titanium alloy (Ti-6Al-4V) and the pin elements 132 are formed of the same titanium alloy.

The container 158 is filled with the metal powder 162 in a vacuum environment. As soon as the container 158 is filled, the container is sealed. The metal powder 162 is then cold compacted by subjecting the container 158 to a cold isostatic pressing operation.

During the cold isostatic pressing operation, hydrostatic pressure forces, corresponding to the forces 50 of FIG. 5, are applied over the entire surface of the sealed container 158 at a relatively low temperature, that is a temperature of less than 250° F. and usually about 75° F. Hydrostatic pressure forces, indicated by arrows 50 in FIG. 5, cause the spherical particles of the metal powder 162 to be plastically deformed or cold worked. The particles of the metal powder 162 are plastically deformed by being pressed against each other in the manner illustrated schematically in FIG. 6 for the powder particles 54. The powder particles are also plastically deformed or cold worked by being pressed against the core 130, in the manner illustrated in FIG. 7 for the powder particles 54. During the cold working, there is no significant bonding between the particles of the metal powder 162.

After the metal powder 162 has been cold compacted and the spherical metal powder particles plastically deformed by cold working, the metal powder is hot compacted. Hot compacting bonds the particles of the metal powder 162 together and forms a unitary body which encloses the core 130. The sealed container 158 of cold worked metal powder is hot compacted by being subjected to a hot isostatic pressing operation.

The hot isostatic pressing operation takes place in an autoclave at a temperature between 1,200° F. and 1,850° F. and a pressure between 15,000 and 45,000 pounds per square inch for one and a half to three hours. The heat and pressure results in the metal particles bonding together to form a unitary body which surrounds the cores. During the bonding of the particles of metal powder together, the material of the pin elements 132 becomes diffusion bonded with the material of the metal powder. Since the pin elements 132 are formed of the same material as the powder 162 or at least a major component of the metal powder, the material of the pin elements 132 can be diffusion bonded with the metal powder during hot compacting without adversely effecting the characteristics of the resulting unitary body of material.

After the hot compacting of the metal powder 162, the container 158 is removed from the outside of the resulting unitary metal body. In addition, the core 130 is removed from inside the metal body formed by the bonding of the particles of the metal powder 162. This may be done with a hot nitric acid solution. The projections 142 and 144 on the core 130 provide access to the core. However, if these projections are eliminated, an opening could be drilled or otherwise cut in the body formed by the bonded particles of metal powder to provide access to the core 130.

In the embodiment of the invention illustrated in FIGS. 12–14, the pin elements 132 are connected to the core 130 before the body 138 of pattern material surrounds the core. However, it is contemplated that the body of pattern material 138 could be injection molded around the core 130 and then the pin elements 132 extended through the body of pattern material into engagement with the core. If this was done, the inner end portions 134 of the pin elements 132 would abut the surface of the core 130 rather than being received in recesses or openings formed in the core. Insertion of the pin elements through the body 138 of wax pattern material may be facilitated by heating the pin elements and then pressing them through the body 138 of wax pattern material.

The pin elements 132 have been shown in FIGS. 12–14 as extending into areas corresponding to the leading and trailing edge portions of an airfoil. However, it is contemplated that the pin elements may extend outwardly from major side surfaces of the core 130 to locations corresponding to major side surface of the airfoil. Regardless of where and how the pin elements 132 are extended through the pattern material, the inner ends 134 of the pin elements will engage the core 130. The outer ends 148 of the pin elements project from the body 138 of pattern material so that they can be anchored in the metal layer 152.

Airfoil-Third Embodiment

In the embodiment of the airfoil illustrated in FIGS. 9–11, the internal recess 92 opens only at the root end portion 96 of the airfoil. In the embodiment of the airfoil illustrated in FIGS. 12–14, the internal recess in the airfoil has two small openings where the core projections 142 and 144 are removed. However, it is contemplated that the airfoil could be formed with an internal recess which extends completely through the airfoil, that is between the root and tip end portions of the airfoil. Thus, in the embodiment of the airfoil illustrated in FIGS. 15 and 16, the recess extends between opposite longitudinal end surfaces of the airfoil.

A rigid low carbon steel core 168 (FIG. 15) extends through and projects from opposite ends of a body 170 of pattern material. Even though the body 170 of wax pattern material has been illustrated very schematically in FIG. 15 as having a generally rectangular configuration, it should be understood that the body 170 of wax pattern material has a configuration corresponding to the configuration of an airfoil. The core 168 has also been illustrated very schematically in FIG. 15. However, the core 168 has a configuration which corresponds to the configuration of a recess to be formed in an airfoil. The core 168 has projecting end portions 174 and 176 which extend beyond the desired length of the airfoil.

Figure 15:
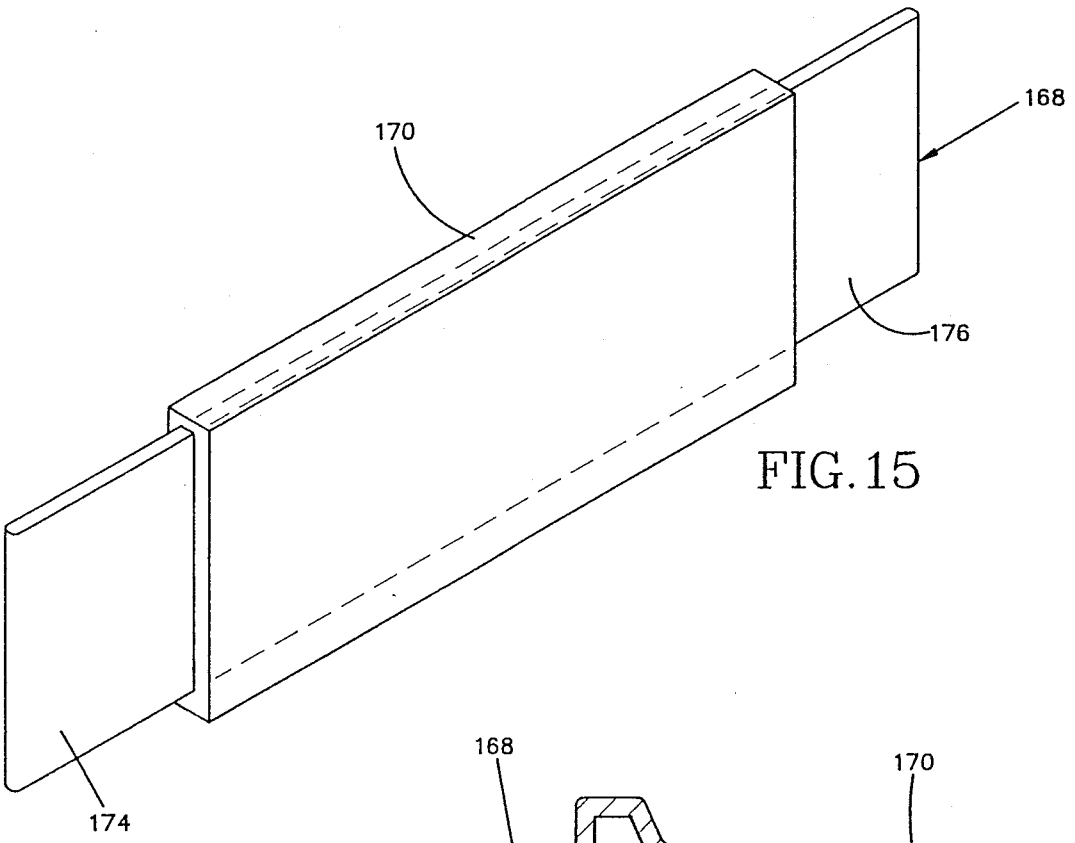
FIG. 15 is a highly schematicized illustration depicting the relationship between a core and body of pattern material for an airfoil having a recess with openings in both ends of the airfoil.
Figure 16:
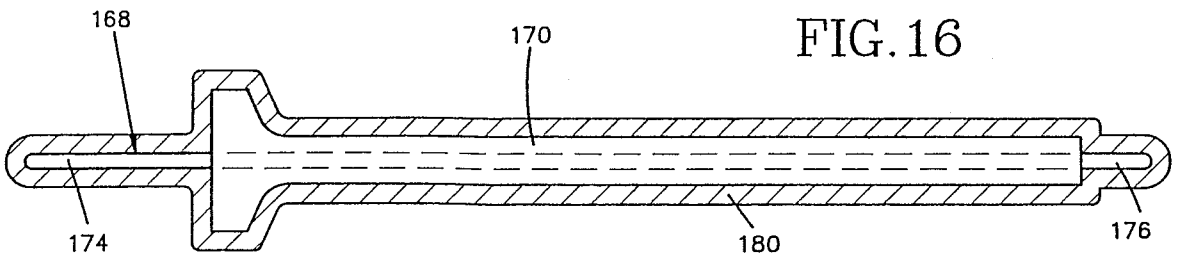
FIG. 16 is a schematic sectional view depicting the manner in which a layer of metal is deposited over the core and pattern material of FIG. 15.

A metal layer 180 (FIG. 16) is electroplated or otherwise deposited over the pattern assembly of FIG. 15. The metal layer 180 extends over both the body 170 of wax pattern material and over the projecting end portions 174 and 176 of the core 168. This results in the core 168 being gripped at its opposite ends by the metal layer 180.

The wax pattern material 170 is removed from within the layer 180 of metal to form a container having an internal cavity through which the core 168 extends. This container is filled with metal powder, sealed, subjected to a cold compacting process and then subjected to a hot compacting process in the manner previously explained in conjunction with the embodiments of the invention illustrated in FIGS. 1–14. After the hot compacting process has been completed, the container and core are removed from the resulting unitary body of metal.

Conclusion

In view of the foregoing description, it is apparent that the present invention provides a new and improved method of forming a metal article 20 from metal powder. When the metal article 20 is hollow or contains an internal recess 22, a container 42 for holding metal powder 44 is formed with a core 32 in the container. The container is formed by first covering the core 32 with a body 34 of pattern material (FIG. 2) having a configuration which is a function of the configuration of the metal article 20. A layer 36 (FIG. 3) of metal is deposited over the pattern 34 and the core 32. The pattern material 34 is then removed from within the layer 36 of metal to leave a container 42 (FIG. 4) with the core 32 therein. If the metal article 20 does not have an internal recess 22, the core would be omitted.

The container 42 is filled with metal powder 44 which at least partially surrounds the core 32. The metal powder 44 is cold compacted by exposing the container 42 to fluid at a relatively low temperature and a relatively high pressure. The fluid pressure against the container 42 presses the particles 54 of metal powder against each other (FIG. 6) and against the core 32 (FIG. 7) to plastically deform or cold work all of the metal particles 54. During cold compacting, there is no significant bonding between the metal particles 54.

After the particles 54 of metal powder have been cold compacted (FIG. 5), they are hot compacted (FIG. 8) to bond the particles 54 together. This results in the formation of a unitary body 58 which at least partially surrounds the core 32. The plastically deformed particles 54 of metal powder recrystallize with a fine grain size. The fine grain size of the recrystallized metal powder enhances the fatigue strength of the article 20. After the hot compacting process (FIG. 8) has been completed, the core 32 is removed from the unitary body 58.

Figure 3:
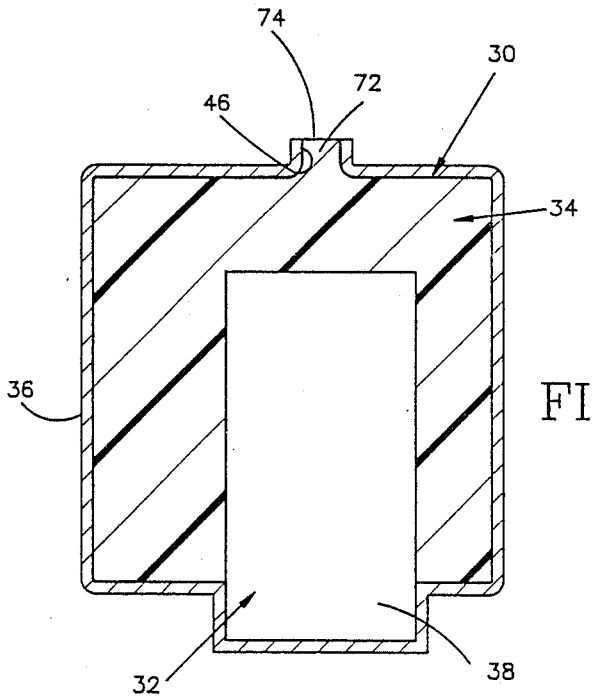
FIG. 3 is a sectional view illustrating a layer of metal which is deposited over the pattern assembly of FIG. 2.

When a recess formed in a metal article extends from one or both ends of the article (FIGS. 9 and 15), a core may be held in place in the container by having one or both ends of the core gripped by the container. Thus, the recess 22 has an opening at one end 24 of the article 20. An end 38 of the core 32 projects from one end of the body 34 of pattern material. The layer 36 of metal which is deposited over the body 34 of pattern material to form the container 42 is also deposited over the exposed end 38 of the core 32 (FIG. 3). This results in the core 32 being gripped by the layer 36 of metal to hold the core and layer of metal against movement relative to each other.

With certain articles, it is contemplated that it may be desirable to support the core in a manner other than by gripping it with the container. This can be done by having pin elements 132 (FIGS. 12–14) extend through the pattern material (138 (FIG. 13)). An outer end portion 148 of each of the pin elements 132 projects from the body 138 of pattern material (FIG. 13). An inner end portion 134 of each of the pin elements 132 engages the core 130. When a layer of metal 152 is deposited over the body 138 of pattern material, the metal is deposited around the projecting outer end portions 148 of each of the pin elements 132 to anchor the pin elements in the layer of metal. The pin elements 132 will subsequently position the core 130 during filling of the container 158 with metal powder 162 (FIG. 14).

Having described specific preferred embodiments of the invention, the following is claimed:

1. A method of forming a metal article from powdered metal, said method comprising the steps of providing a metal container with a rigid core disposed therein, filling the container with metal powder, said step of filling the container with metal powder including at least partially surrounding the core with the metal powder, thereafter, cold compacting the metal powder to plastically deform particles of the metal powder without significant bonding between the particles of the metal powder, said step of cold compacting the metal powder includes exposing the container to fluid at a relatively low temperature and a relatively high pressure, pressing the metal powder particles against each other under the influence of fluid pressure applied against the container, pressing the metal powder particles against the core under the influence of fluid pressure applied against the container, and deforming the metal powder particles as they are pressed against each other and against the core, thereafter, hot compacting the metal powder to bond the particles of metal powder together and form a unitary body which at least partially surrounds the core, and removing the core from the unitary body to form a recess in the unitary body.

2. A method as set forth in claim 1 further including the steps of sealing the container prior to performing said step of cold compacting the metal powder and maintaining the container sealed until completion of said step of hot compacting the metal powder.

3. A method as set forth in claim 1 wherein said step of providing a metal container with a rigid core therein includes the steps of providing a rigid core, partially surrounding the core with a body of pattern material having a configuration corresponding to the configuration of at least a portion of the article, depositing a layer of metal over the body of pattern material and over at least a portion of the core, removing the body of pattern material from within the layer of metal to leave space between the layer of metal and at least a portion of the core, and holding the core against movement relative to the layer of metal by gripping the core with the layer of metal, said step of filling the container with metal powder including filling the space between the layer of metal and the core with metal powder.

4. A method as set forth in claim 3 wherein said step of gripping the core with the layer of metal includes gripping only one end portion of the core wit the layer of metal, an end portion of the core opposite from the one end portion being surrounded by and spaced apart from the layer of metal.

5. A method as set forth in claim 3 wherein said step of gripping the core with the layer of metal includes gripping opposite end portions of the core with the layer of metal, a portion of the core disposed between the opposite end portions of the core being surrounded by and spaced apart from the layer of metal.

6. A method as set forth in claim 3 wherein said step of partially surrounding the core with a body of pattern material includes leaving one end portion of the core projecting from the body of pattern material and surrounding an end portion of the core opposite from the one end portion with the body of pattern material, said step of depositing a layer of metal over at least a portion of the core includes depositing a layer of metal over the one end portion of the core, said step of gripping the core with the layer of metal includes gripping the one end portion of the core with the layer of metal.

7. A method as set forth in claim 3 wherein said step of partially surrounding the core with a body of pattern material includes leaving first and second end portions of the core projecting from the body of pattern material and surrounding a portion of the core disposed between the first and second end portions with the body of pattern material, said step of depositing a layer of metal over at least a portion of the core includes depositing a layer of metal over the first and second end portions of the core, said step of gripping the core with the layer of metal includes gripping the first and second end portions of the core with the layer of metal.

8. A method as set forth in claim 1 wherein said step of providing a metal container with a rigid core therein includes the steps of at least partially surrounding the core with a body of pattern material through which pin elements extend into engagement with the core, the body pattern material having a configuration corresponding to the configuration of at least a portion of the article, depositing a layer of metal over the body of pattern material and over end portions of the pin elements, removing the body of pattern material from within the layer of metal to leave the pin elements extending through space between the layer of metal and the core, and holding at least a portion of the core and at least a portion of the metal layer against relative movement under the influence of forces transmitted between the core and the layer of metal by the pin elements, said step of filling the container with metal powder including filling the space between the layer of metal and the core with metal powder and surrounding portions of the pin elements disposed between the metal layer and core with metal powder.

9. A method as set forth in claim 8 wherein said step of cold compacting the metal powder is performed with the pin elements extending between the metal layer and the core.

10. A method as set forth in claim 9 wherein said step of hot compacting the metal powder is initiated with the pin elements extending between the metal layer and the core.

11. A method as set forth in claim 10 wherein at least a major portion of the material of which the pin elements are composed corresponds to at least a major portion of the material of which the particles of metal powder are formed, said step of hot compacting the metal powder including bonding the material of the pin elements with the material of the particles of metal powder.

12. A method of forming an airfoil from metal powder, said method comprising the steps of forming a container having a cavity with a configuration which is a function of the configuration of the airfoil, said step of forming a container including providing a pattern having a configuration which is a function of the configuration of the airfoil, depositing a layer of metal over the pattern and removing the pattern from within the layer of metal, filling the container with a metal powder, sealing the filled container, thereafter, cold compacting the metal powder to plastically deform the particles of the metal powder without significant bonding between the particles of metal powder, said step of cold compacting the metal powder includes exposing the container to fluid at a relatively low temperature and a relatively high pressure, pressing the container against the metal powder particles and pressing the metal powder particles against each other under the influence of fluid pressure applied against the container, and deforming the metal powder particles, thereafter, hot compacting the metal powder to bond the particles of metal powder together to form a unitary body having a configuration corresponding to the configuration of the airfoil, and maintaining the container sealed throughout performance of said steps of cold and hot compacting the metal powder.

13. A method as set forth in claim 12 further including the step of supporting a rigid core in the container, said step of filling the container with metal powder including at least partially surrounding the core with the metal powder, said step of cold compacting the metal powder includes pressing the particles of metal powder against the core under the influence of fluid pressure applied against the container.

14. A method as set forth in claim 13 wherein said step of depositing a layer of metal over the pattern includes electroplating a layer of metal over at least a portion of the core, said method further including the step of holding the core against movement relative to the layer of metal by gripping the core with the layer of metal.

15. A method as set forth in claim 14 wherein said step of gripping the core with the layer of metal includes gripping only one end portion of the core with the layer of metal, an end portion of the core opposite from the one end portion being surrounded by and spaced apart from the layer of metal.

16. A method as set forth in claim 14 wherein said step of gripping the core with the layer of metal includes gripping opposite end portions of the core with the layer of metal, a portion of the core disposed between opposite end portions of the core being surrounding by and spaced apart from the layer of metal.

17. A method as set forth in claim 12 further including the step of providing a rigid core, said step of providing a pattern includes at least partially surrounding the core with a body of pattern material with pin elements extending through the pattern material into engagement with the core, said step of depositing a layer of metal over the pattern including depositing the layer of metal over end portions of the pin elements to anchor the pin elements against movement relative to the layer of metal, said step of removing the pattern from the layer of metal including leaving the pin elements extending through space between the layer of metal and the core, said method further including holding at least a portion of the core and at least a portion of the metal layer against relative movement under the influence of forces transmitted between the core and the layer of metal by the pin elements, said step of filling the container with metal powder including filling the space between the core and the layer of metal with metal powder and surrounding portions of the pin elements with the metal powder.

18. A method as set forth in claim 17 wherein said step of cold compacting the metal powder is performed with the pin elements extending between the metal layer and the core.

19. A method as set forth in claim 18 wherein said step of hot compacting the metal powder is initiated with the pin elements extending between the metal layer and the core.

20. A method of forming a metal article from powdered metal, said method comprising the steps of providing a rigid core having a configuration which at least partially corresponds to the configuration of a recess to be formed in the article, enclosing at least a portion of the core with a body of pattern material having a configuration corresponding to the configuration of the article, extending pin elements through the pattern material with a first end portion of each of the pin elements projecting from the pattern material and a second end portion of each of the pin elements engaging the core, depositing a layer of metal over the body of pattern material and over at least a portion of the core to at least partially form a container, said step of depositing a layer of metal including depositing the layer of metal around the first end portion of each of the pin elements to anchor the first end portion of each of the pin elements in the layer of metal, removing the body of pattern material from within the layer of metal to leave space between the layer of metal and at least a portion of the core with the pin elements extending through the space between the layer of metal and the core, holding at least a portion of the core and at least a portion of the metal layer against relative movement under the influence of forces transmitted between at least a portion of the core and at least a portion of the metal layer by the pin elements, filling the container with metal powder, said step of filling the container with metal powder including filling the space between the core and metal layer with metal powder and at least partially surrounding the core and pin elements with metal powder, thereafter, sealing the container, hot compacting the metal powder to bond particles of the metal powder together and form a unitary bonding the material of the pin elements with the material of the particles of metal powder, and removing the core from the unitary body to form a recess in the unitary body.

21. A method as set forth in claim 20 further including the step of cold compacting the metal powder to plastically deform the particles of the metal powder after performing said step of filling the container with metal powder and prior to performance of said step of hot compacting the metal powder.

22. A method of forming a metal article, said method comprising the steps of providing a core having an end portion and a body portion extending outwardly from the end portion, holding the core in a predetermined position relative to a die with the body portion of the core at least partially disposed in a die cavity, said step of holding the core including gripping the end portion of the core with the die, conducting pattern material into the die cavity while gripping the end portion of the core with the die to form a body of pattern material which at least partially encloses the body portion of the core, removing the core and body of pattern material from the die, depositing a layer of metal over the body of pattern material and over at least a portion of the core to at least partially form a container, said step of depositing a layer of metal including depositing the layer of metal over the end portion of the core previously gripped by the die, removing the body of pattern material from within the container to leave space between the layer of metal and at least a portion of the core, holding at least a portion of the core and at least a portion of the metal layer against relative movement under the influence of forces transmitted between the end portion of the core previously gripped by the die and the metal layer, filling the container with meal powder, said step of filling the container with metal powder including at least partially filling the space between the core and metal layer with metal powder and at least partially surrounding the core with metal powder, thereafter, sealing the container, and hot compacting the metal powder to bond particles of the metal powder together and form a unitary body.

23. A method as set forth in claim 22 further including the step of cold compacting the metal to plastically deform particles of the metal powder without significant bonding between the particles of metal powder, said step of cold compacting the metal powder being performed with the powder in the container after performance of said step of filling the container with metal powder and prior to performance of said step of hot compacting the metal powder.

24. A method as set forth in claim 23 wherein said step of cold compacting the metal powder includes exposing the container to fluid at a relatively low temperature and relatively high pressure, pressing the metal powder particles against each other under the influence of fluid pressure applied against the container, pressing the metal powder particles against the core under the influence of fluid pressure applied against the container, and deforming the metal particles as they are pressed against each other and against the core.

25. A method as set forth in claim 22 further including the step of removing the core from the unitary body to form a recess in the unitary body.

26. A method as set forth in claim 22 further including the step of extending pin elements through the body of pattern material with a first end portion of each of the pin elements projecting from the pattern material and a second end portion of each of the pin elements engaging the core, said step of depositing a layer of metal including depositing metal around the first end portion of each of the pin elements to anchor the first end portion of each of the pin elements in the layer of metal, said method further including the step of holding at least a portion of the core and at least a portion of the layer of metal against relative movement under the influence of forces transmitted between at least a portion of the core and at least a portion of the metal layer by the pin elements.

27. A method as set forth in claim 26 wherein said step of hot compacting the metal powder includes bonding the material of the pin elements with the material of the particles of metal powder.

28. A method of forming a metal article, said method comprising the steps of providing a core having a body portion and a plurality of locating surface areas, holding the core in a predetermined position relative to a die and with the body portion of the core at least partially disposed in a die cavity, said step of holding the core including engaging the locating surface areas with the die and holding the core in the die cavity under the influence of forces transmitted between the core and the die at the locating surface areas of the core, conducting pattern material into the die cavity while engaging the locating surface areas on the core with the die to form a body of pattern material which is at least partially encloses the body portion of the core, removing the core and body of pattern material from the die with the locating surface areas disposed outwardly of the body of pattern material, depositing a layer of metal over the body of pattern material and over at least portions of the locating surface areas to at least partially form a container, removing the body of pattern material from within the container to leave space between the layer of metal and at least a portion of the core, holding at least a portion of the core and at least a portion of the metal layer against relative movement under the influence of forces transmitted between the core and metal layer at the locating surface areas of the core, filling the container with metal powder, said step of filling the container with metal powder including at least partially filling the space between the core and metal layer with metal powder and at least partially surrounding the core with metal powder, thereafter, sealing the container, and hot compacting the metal powder to bond particles of the metal powder together and form a unitary body.

29. A method as set forth in claim 28 wherein the core includes a plurality of projection which extend outwardly from the portion of the core, said step of engaging the locating surface areas with the die including engaging outer end portions of the projections with the die at a plurality of spaced apart locations.

30. A method as set forth in claim 29 wherein said step of depositing a layer of metal includes depositing metal over the outer end portions of the projections.

31. A method as set forth in claim 30 wherein said step of removing the body of pattern material from within the container includes leaving the projections extending through the space between the layer of metal and the core.

32. A method as set forth in claim 29 wherein said step of hot compacting the metal powder includes bonding the material of the projections with the material of the particles of metal powder.

33. A method as set forth in claim 28 further including the step of removing the core from the unitary body to form a recess in the unitary body.

34. A method as set forth in claim 28 further including the step of cold compacting the metal powder to plastically deform particles of the metal powder without significant bonding between the particles of metal powder, said step of cold compacting the metal powder being performed with the metal powder in the container after performance of said step of filling the container with metal powder and prior to performance of said step of hot compacting the metal powder.

35. A method as set forth in claim 34 wherein said step of cold compacting the metal powder includes exposing the container to fluid at a relatively low temperature and relatively high pressure, pressing the metal powder particles against each other under the influence of fluid pressure applied against the container, pressing the metal powder particles against the core under the influence of fluid pressure applied against the container, and deforming the metal particles as they are pressed against each other and against the core.

36. A method as set forth in claim 28 wherein the core has an end portion which extends outwardly from the body portion of the core, the locating surface areas being disposed on said end portion of the core, said step of engaging the locating surface areas with the die including gripping the end portion of the core with the die.

37. A method as set forth in claim 28 wherein the core has a pair of end portion which extend outwardly in opposite directions from the body portion of the core, the locating surface areas being disposed on both of the end portions of the core, said step of engaging the locating surface areas with the die including gripping both of the end portions of the core with the die.

* * * * *

UNITED STATES PATENT AND TRADEMARK OFFICE

CERTIFICATE OF CORRECTION

PATENT NO. : 4,861,546

DATED : August 29, 1989

INVENTOR(S) : Gerald I. Friedman

It is certified that error appears in the above-identified patent and that said Letters Patent is hereby corrected as shown below:

Column 16, Line 46, Change "wit" to --with--.

Column 19, Line 27, Insert --body, said step of hot compacting the metal powder including-- between "unitary" and "bonding".

Column 19, Line 61, Change "meal" to --metal--.

Column 20, Line 2, Insert --powder-- between "metal" and "to".

Column 20, Line 6, Insert --metal-- between the first occurence of "the" and "powder".

Column 20, Line 54, Delete "is".

Column 21, Line 8, Change "projection" to --projections--.

Column 22, Line 25, Change "portion" to --portions--.

Signed and Sealed this

Eleventh Day of September, 1990

*Attest:*

HARRY F. MANBECK, JR.

*Attesting Officer*

*Commissioner of Patents and Trademarks*